United States Patent [19]

Sumiyoshi et al.

[11] Patent Number: 4,975,674

[45] Date of Patent: Dec. 4, 1990

[54] SURGE ABSORBER

[75] Inventors: Mikio Sumiyoshi, Hirakata; Homeru Igarashi, Eniwa; Taizou Hashizume, Chitose, all of Japan

[73] Assignee: Matsushita Electric Industrial Co., Ltd., Osaka, Japan

[21] Appl. No.: 298,746

[22] PCT Filed: May 27, 1988

[86] PCT No.: PCT/JP88/00517

§ 371 Date: Jan. 12, 1989

§ 102(e) Date: Jan. 12, 1989

[87] PCT Pub. No.: WO88/09556

PCT Pub. Date: Dec. 1, 1988

[30] Foreign Application Priority Data

May 28, 1987 [JP] Japan ..... 62-132442
Aug. 26, 1987 [JP] Japan ..... 62-212003

[51] Int. Cl.[5] ..... H01C 7/10
[52] U.S. Cl. ..... 338/21; 361/117
[58] Field of Search ..... 338/20, 21; 361/117, 361/118, 119, 120, 127, 128, 129

[56] References Cited

U.S. PATENT DOCUMENTS

| | | | |
|---|---|---|---|
| 3,958,154 | 5/1976 | Hill et al. | 361/120 X |
| 4,262,317 | 4/1981 | Baumbach | 361/119 X |
| 4,396,970 | 8/1983 | Scuder, Jr. | 361/127 |
| 4,538,347 | 9/1985 | Palilla et al. | 29/619 |
| 4,714,910 | 12/1987 | Schwingenschuh et al. | 338/21 |

FOREIGN PATENT DOCUMENTS

| | | |
|---|---|---|
| 3509014 | 9/1986 | Fed. Rep. of Germany . |
| 44-17568 | 7/1969 | Japan . |
| 55-13121 | 4/1980 | Japan . |

*Primary Examiner*—Bruce A. Reynolds
*Assistant Examiner*—Marvin M. Lateef
*Attorney, Agent, or Firm*—Stevens, Davis, Miller & Mosher

[57] ABSTRACT

In contrast to a conventional surge absorber in which external terminals (4*a*), (4*b*) are led from disshaped electrode plates (3*a*), (3*b*) soldered to the surfaces of electrodes (2) on a varistor element (1), a surge absorber of the present invention has a varistor element (5), electrodes (6) provided on both sides of the varistor element (5) and electrode plates (7*a*), (7*b*) soldered to the surfaces of the electrodes (6), each electrode plates (7*a*), (7*b*) having at least one of substantially radial slots and an external terminal (8*a*), (8*b*) extended substantially from the center thereof. The surge absorber according to the present invention enables the electrode plates (7*a*), (7*b*) to be held in uniform contact with the electrodes (6) during soldering by virtue of the fact that the external terminals (8*a*), (8*b*) are led from the central regions thereof, so that the soldering can be conducted effected stably. In addition, since the external terminals (8*a*), (8*b*) and led from the central regions of the electrode plates, the electric current in the varistor element is uniformalized to provide a greater surge proof current capacity.

5 Claims, 6 Drawing Sheets

SURGE ABSORBER

TECHNICAL FIELD

The present invention relates to a surge absorber for protecting electronic devices from abnormal over voltages such as a switching surge voltage, a lighting surge voltage, and so forth.

BACKGROUND ART

Current diversification of functions of electronic devices have put electronics using semiconductors into practical use in various fields including household devices, data processing devices, communication systems and industrial devices. Semiconductors such as ICs, LSIs, thyristors and so forth used in these electronics have excellent performance but are very sensitive to abnormal voltage which may be applied by electrostatic discharges, lightning and so forth, so that troubles such as malfunction or breakdown of the electronic devices tend to be caused when abnormal voltage is exerted thereto. It is therefore a matter of great significance to take a suitable measure against surge voltages from the view point of security and an improvement of the electronic devices.

FIGS. 6(*a*), 6(*b*) and 6(*c*) show an example of a known surge absorber. Referring to these Figures, a reference numeral 1 denotes a tabular varistor element usually made of a semiconductor ceramics mainly composed of zinc oxide, strontium titanate or the like, while 2 denotes electrodes which are provided on the corresponding portions of the front and rear sides of the varistor element 1 by, for example, firing of silver paste. The electrode 2 on the rear side of the varistor element 1 is not shown in these Figures. Numerals 3*a* and 3*b* show metallic electrode plates made of materials which have a high degree of electrical conductivity such as copper or brass. The electrode plates 3*a* and 3*b* are connected to the electrodes 2 by soldering of solder paste. A reference numeral 4*a* designates an external terminal which is led from a portion of the electrode plate 3*a*. Usually, the external terminal 4*a* is made of the same material as the electrode plate 3*a*. This applies also to another external terminal 4*b* provided on the rear side. The ends of the external terminals 4*a* and 4*b* are connected to an electric circuit by soldering or by means of bolts. Practically, the surge absorber is resin-coated or resin-molded such that only the ends of the external terminals are exposed, though not shown in FIGS. 6(*a*) to 6(*c*).

The operation of this known surge absorber will be described hereinunder.

The external terminals 4*a* and 4*b* are connected between the power supply lines, signal lines or grounding lines of the device to be protected, so as to absorb any abnormal voltage which has been introduced into these lines due to, for example, electrostatic discharge, lightning surge, and so forth. The surge current produced by the abnormal voltage flows from the external terminal 4*a* on the front side of the surge absorber to the external terminal 4*b* on the rear side thereof, through electrode plate 3*a*, electrode 2, varistor element 1, and the corresponding portions on the rear side of the surge absorber so that the voltage suppressed to a safe level is applied to the device to be protected.

This known arrangement, however, suffers from a disadvantage in connection with the production. Namely, in producing the surge absorber, external terminals 4*a* and 4*b* are held by means of jigs so as to support the varistor element 1 therebetween by spring action of the external terminals 4*a*, 4*b* during soldering of the electrodes 2, 2 and the electrode plates 3*a*, 3*b* together. In such a case, the varistor element 1 is supported solely by the external terminals 4*a* and 4*b* only at the free ends thereof so that only a slight variation in the thickness of the varistor element 1 causes uniform contact between the electrode plates 3*a*, 3*b* and the electrodes 2 on the element 1 to be not ensured, resulting in that the soldering cannot be done uniformly.

Even if the electrode plates 3*a*, 3*b* are held in uniform contact with the electrodes 2 on both sides of the element 1, flux voids tend to remain between the electrode plates 3*a*, 3*b* and the electrodes 2, thus making it difficult to ensure uniformity of the soldering.

These unfavorable factors undesirably impair performance in regard to withstanding surge current capacity, which is one of the most critical requirements for a surge absorber, resulting in a lowered reliability of the surge absorber.

The soldering of the electrode plates 3*a*, 3*b* to the electrodes 2 is usually conducted by printing paste solder on the surfaces of the electrodes 2, drying the paste solder and pressing the electrodes plates 3*a*, 3*b* onto the electrodes 2 under application of heat. Such a method, however, is very expensive.

DISCLOSURE OF THE INVENTION

In order to overcome the above-described problems of the prior art, the present invention provides a surge absorber in which the electrode plates to be soldered to the electrodes on both sides of a tabular varistor have a specific structure. More specifically, a slot is formed in the electrode plate substantially in the radial direction thereof so as to allow an external terminal to be led substantially from the center of the electrode plate. In addition, each electrode plate to be soldered to the electrode of the varistor has the form of a plurality of lines which extend from a single point or a line. In other words, the electrode on each side of the varistor is soldered thereon with an electrode plate having line electrodes which extend radially from approximately the center region of the associated electrode or which extend on both sides from a center line electrode that extends diametrically of the electrode.

With this arrangement of the invention, a uniform contact and, hence, uniform soldering between the electrode and the electrode plate can be achieved regardless of any slight variation in the thickness of the varistor element, partly because a support is given by the lead-out portion of the external terminal lead of which is connected to the center portion of the electrode plate, and partly because a certain degree of flexibility is provided at the portion from which the external electrode plate is led, by virtue of the formation of the substantially radial slot in the electrode plate. In addition, since the electrode plates uniformly make contact with the electrode, the electrodes can hold the varistor element with a greater level of stability during the soldering.

With this arrangement, since each electrode plate soldered on the electrode on the varistor has a plurality of line electrodes, soldering can be achieved uniformly without allowing flux and air voids to remain between the electrode plates and the electrodes. Further this arrangement also reduces the production cost remarkably because the soldering can be effected by a solder dip method without the aid of solder paste.

Since a satisfactory contact condition between the electrode on the varistor and each electrode plate is achieved, the surge current absorption capacity is enhanced in comparison with that of a conventional device.

THE BEST MODE FOR CARRYING OUT THE INVENTION

Figure 1:
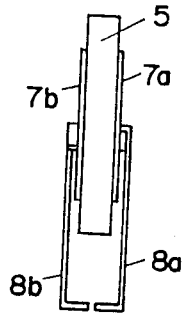
FIGS. 1 to 5 are illustrations of different embodiments of a surge absorber in accordance with the present invention in which sections (a), (b) and (c) are side elevational views, front elevational views and perspective views, respectively.
Figure 1:
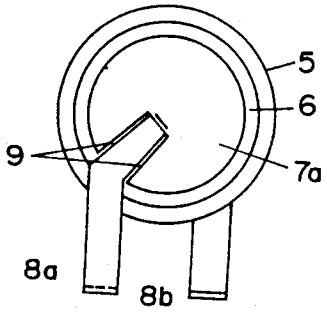
Figure 1:
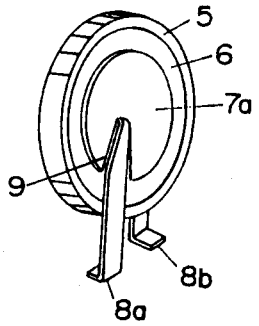

FIG. 1 shows a surge absorber wherein sections (a), (b) and (c) of this Figure are a side elevational view, a front elevational view and a perspective view of this embodiment.

Referring to FIG. 1, a reference numeral 5 denotes a varistor element made of a material which is mainly composed of zinc oxide, 6 electrodes formed on the front and rear surfaces (the rear surface is not shown) of the varistor element 5 and 8*a* and 8*b* external terminals which are led in the same direction and which are bent at their one end inwardly as viewed in the thicknesswise direction of the varistor element 5. The one ends of the external terminals may be provided with notches or holes for external wiring. These elements correspond to the varistor element 1, electrodes 2, and external terminals 4*a* and 4*b* of the conventional surge absorber. Numerals *7a* and *7b* denote electrode plates which are provided with slots 9 which extend substantially in a radial direction and which are soldered to the electrodes 6 by solder paste. The electrode plates *7a*, *7b* are made of a material having a high level of electrical conductivity, e.g., copper, a copper alloy or iron, and is plated on their outer surface with solder. The external terminals 8*a*, 8*b* and the electrode plates *7a*, *7b* are formed from a metal sheet by press work. The widths of them are adjusted at the connecting portions so as to provide sufficient flexibility at these connecting portions. The external terminals 8*a* and 8*b* are led substantially from the central portions of the electrode plates *7a*, *7b*.

Although not illustrated in FIG. 1, the surge absorber in accordance with the present invention is in most cases coated or molded with an insulating resin such that only ends of the external terminals 8*a* and 8*b* are exposed. Such coating or molding may be omitted if an insulating layer of a glass, resin or the like is formed on the outer peripheral portion of the varistor element 5. The external terminals 8*a* and 8*b* in the device of the present invention has a double function: namely a function as electric terminals and a terminals and a function as structural members which support the body of the surge absorber.

The operation of the surge absorber of FIG. 1 will be explained hereinafter. When a surge voltage is applied to the surge absorber, a surge current flows through the varistor element 5 and the surge is absorbed substantially in the same manner as that in the conventional surge absorber. In the FIG. 1 surge absorber, however, since the electrode plates *7a* and *7b* which are connected to the electrodes 6 have external terminals which are led from the substantially central portions of the electrode plates *7a* and *7b*, the electrode plates *7a* and *7b* are held in uniform contact with the electrodes 6 during soldering so that the electrode plates *7a* and *7b* are uniformly soldered and connected to the electrodes 6, thus eliminating degradation of performance such as the withstanding surge current capacity. In addition, since the surge current enters the varistor element 5 substantially at the central portion of the varistor element 5, a uniform electric current distribution is obtained throughout the varistor element 5. This also contributes to an improvement in the withstanding surge current capacity of the surge absorber.

In addition, since the external terminals 8*a* and 8*b* are bent at their outer ends inwardly as viewed in the direction thicknesswise of the varistor element, the space required for connection of these terminals can be saved. In addition, the bent ends of the external terminal 8*a* and 8*b* enables the surge absorber to stand by itself. Practically, the whole portion of the surge absorber except for the ends of the external terminals 8*a* and 8*b* is coated or molded with a resin so that the surge absorber can have superior abilities of weather-resistance and electrical insulation.

A first embodiment of the invention will be described with reference to FIG. 2. The sections (a), (b) and (c) of this Figure are a side elevational view, a front elevational view and a perspective view of the second embodiment.

Figure 2A:
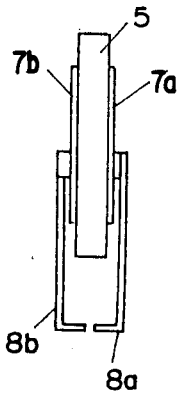
Figure 2B:
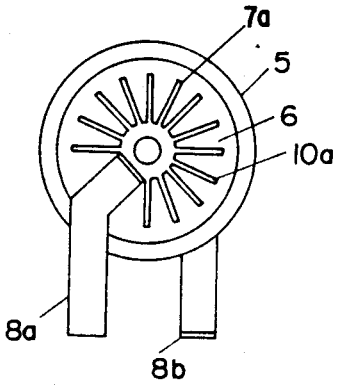
Figure 2C:
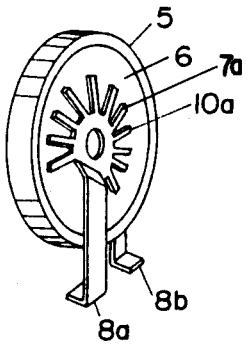

Referring to FIG. 2, a reference numeral 5 denotes a varistor element made of a material preferably composed of, for example, zinc oxide, 6 denotes electrodes formed on the front and rear sides of the varistor element 5, and 8*a* and 8*b* denote external terminals. These portions correspond to the varistor element 1, electrodes 2 and external terminals 4*a*, 4*b* of the conventional surge absorber. Numerals *7a* and *7b* denote electrode plates each having a plurality of line electrodes 102, 106 which extend radially outwardly from a central region of the associated electrode 6 as shown in FIG. 2. These electrode plates are soldered to corresponding electrodes 6 by dip-soldering. The electrode plates *7a*, *7b* having the line electrodes 10*a* and 10*b* are made of a material which have high electrical conductivity, e.g., copper, a copper alloy or iron. Each line electrode 10*a*, 10*b* has a width of 0.5 to 2.5 mm, and the external electrodes 8*a* and 8*b* are connected to the central regions from which the line electrodes 10*a* and 10*b* extending radially outwardly therefrom. An outer resin coating is omitted from the Figure.

The operation of the surge absorber having the described construction will be explained hereinunder.

As in the case of a conventional surge absorber, a surge current flows through the varistor element 5 when a surge voltage is applied thereto and the surge is absorbed substantially in the same manner as the first embodiment. In this embodiment, since the connection to the electrodes 6 is achieved through a plurality of radial line electrodes 10*a*, 10*b*, flux and air voids generated in the course of soldering can easily escape through the gap between adjacent line electrodes without being trapped between the line electrodes and the electrodes 6, whereby the line electrodes 10*a*, 10*b* are uniformly soldered to the electrodes 6, thus enhancing the performance in regard to the withstanding surge current capability The use of the radial line electrodes 10*a*, 10*b* enables the use of a solder-dip method which is inexpensive to carry out. Namely, the external terminals 8*a* and 8*b* are suitably held such that the varistor element 5 is pinched between the line electrodes 10*a*, 10*b* and these parts are dipped in a solder bath whereby the soldering is effected without requiring printing of solder, drying and heating which have to be employed in ordinary paste soldering methods. Further, the surge absorber may be preferably coated or molded with a resin, except at the free end parts of the external terminals 8*a*, 8*b* so as to provide excellent weather resistance and insulation.

Figure 3A:
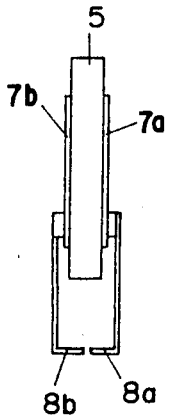
Figure 3B:
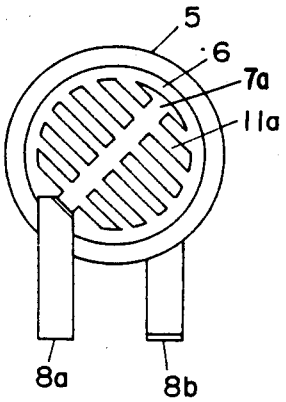
Figure 3C:
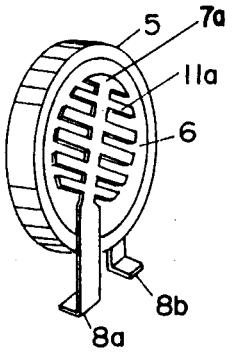

A second embodiment of the present invention will be described with reference to FIG. 3. Sections (a), (b) and (c) of this Figure are a side elevational view, a front elevational view and a perspective view of the third embodiment. This third embodiment is different from the second embodiment only in the form of the line electrodes. Namely, in contrast to the line electrodes 10*a*, 10*b* which radially extend from the central regions of electrodes 6 the line electrodes 11*a*, 11*b* in this embodiment extend on both sides from a single center electrode extending diametrically of the electrode 6. This surge absorber operates substantially in the same manner as the embodiment shown in FIG. 2.

A third embodiment of the present invention will be described with reference to FIG. 4. Sections (a), (b) and (c) of this Figure are a side elevational view, a front elevational view and a perspective view of the fourth embodiment. In this embodiment, the line electrodes are wholly or partially connected at their outer ends. Namely, line electrodes 12*a* and 12*b* which are similar to those of FIG. 2 are connected together at their outer ends by means of a common line electrode 13. Although in the embodiment shown in FIG. 4 all the line 12*a* or 12*b* are connected together at their outer ends, this is only illustrative and some of these line electrodes may not be connected. This surge absorber operates in the same manner as that shown in FIG. 2. However, entanglement of the ends of the line electrodes 12*a* and 12*b* is avoided by the provision of the line electrodes 13 so that the efficiency of the assembly work is improved and the force with which the varistor element is held is also increased advantageously.

Figure 5A:
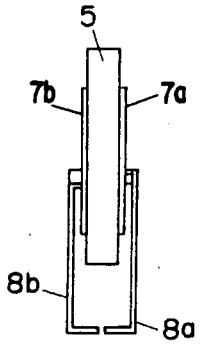
Figure 5B:
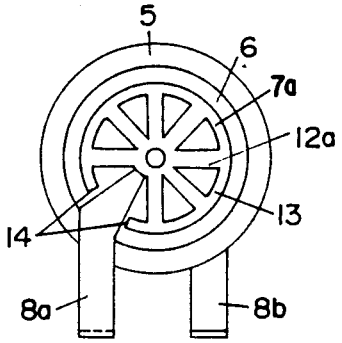
Figure 5C:
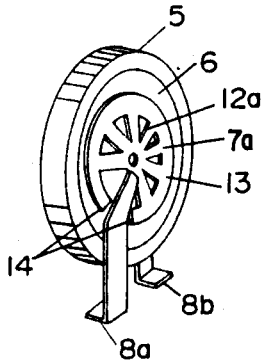
Figure 6A:
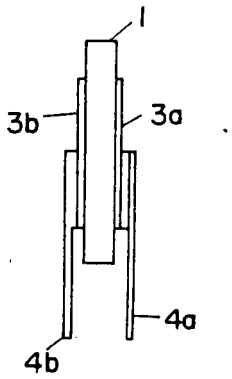
FIG.6(a) PRIOR ART
FIGS. 6(*a*), 6(*b*) and 6(*c*) are a side elevational view, a front elevational view and a perspective view of a conventional surge absorber.
Figure 6B:
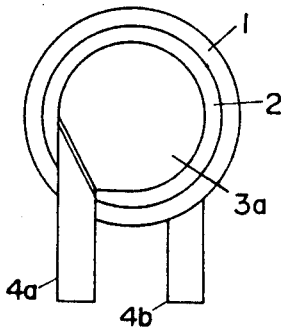
FIG.6(b) PRIOR ART
Figure 6C:
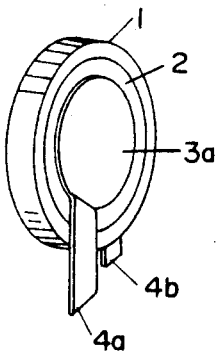
FIG.6(c) PRIOR ART

A fourth embodiment of the present invention will be described hereinunder with reference to FIG. 5. Sections (a), (b) and (c) of this Figure are a side elevational view, a front elevational view and a perspective view of the fourth embodiment. The fifth embodiment is discriminated from the fourth embodiment in that the external terminals 8*a* and 8*b* are lead from the substantially central regions from which the line electrodes 12*a* and 12*b* radially extend. A reference numeral 14 denotes slots from which the external terminals 8*a*, 8*b* are led out similar to that shown in FIG. 1.

Figure 4A:
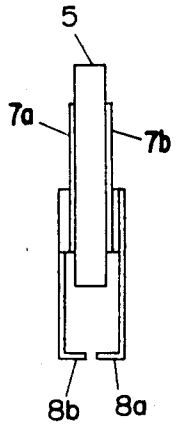
Figure 4B:
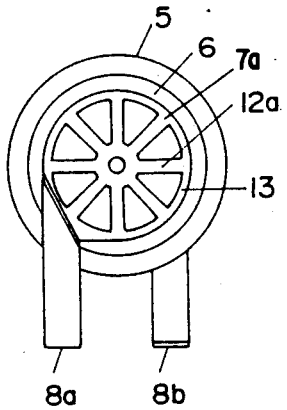
Figure 4C:
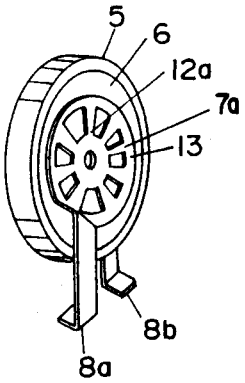

This surge absorber operates substantially in the same manner as that shown in FIG. 4. The fourth embodiment, however, offers an additional advantage in that the electrical current is uniformly distributed throughout the varistor element as in the case of the FIG. 1 device.

INDUSTRIAL APPLICABILITY

As has been described, electrode plates each having a substantially radial slot and having an external terminal which is led substantially from the central portion thereof are soldered to the surfaces of electrodes which are provided on both sides of a tabular varistor element. Alternatively, each electrode plate is constructed in the form of a plurality of line electrodes which extend from a single point or a single line, and an external terminal is led from one of these line electrodes. In other words, each of the electrodes provided on both sides of a tabular varistor has soldered thereon an electrode plate having a plurality of line electrodes which extend radially or which extend on both sides from a center electrode that extends diametrically of the electrode on the varistor. Thus, according to the invention, the electrode plates are held in uniform contact with the electrodes during soldering between the electrode plates and the electrodes on both sides of the varistor element, so that soldering can be effected uniformly without allowing flux and air voids to remain between the electrode plates and the electrodes, whereby a surge absorber having an improved withstanding surge current capability and high degree of reliability can be obtained.

In particular, in the embodiment in which the external terminal is led substantially from the center of the electrode plate, the surge current flows into the varistor element from the central region of the varistor element so that the current is uniformly distributed throughout the varistor element, whereby the effect of improvement in the withstanding surge current capability is enhanced. In addition, the stability of holding of the varistor element during soldering is increased so that the production process becomes applicable also to large-size varistor element.

Further, since the electrode plate has the form of a plurality of line electrodes, soldering can be effected by a solder dipping method without making use of solder paste, so that the cost can be reduced remarkably. In this embodiment, entanglement of the line electrodes at their free ends can be avoided by providing a line electrode which connect at least some of the line electrodes. This arrangement also contributes to improvement in the efficiency of the assembly work and ensures that the varistor element is held with a higher stability.

In addition, in the arrangement in which the ends of the external terminal are bent inwardly as viewed in the direction of thickness of the varistor element, the space for connection of the electrical terminals is conserved advantageously.

Furthermore, a higher degree of weather resistance and insulation power can be obtained by coating or molding the surge absorber such that only the ends of the external terminals are exposed.

What is claimed is:

1. A surge absorber comprising a tabular varistor element, electrodes provided on both sides of said varistor element, electrode plates soldered to the respective electrodes, each said electrode plate having a plurality of line electrodes which extend from approximately a center region of said associated electrode on said varistor and an external terminal led from one part of said each electrode plate.

2. A surge absorber according to claim 1, wherein ends of said line electrodes are wholly or partially connected through a line electrode.

3. A surge absorber according to claim 1, wherein said external terminals are led substantially in a same direction and outer ends of said external terminals are bent inwardly as viewed in a thickness dimension of said varistor element.

4. A surge absorber according to claim 1, wherein said surge absorber is coated or molded with an insulating resin such that said external terminal is exposed only at its ends.

5. A surge absorber comprising a tabular varistor element, electrodes provided on both sides of said varistor element, electrode plates soldered to said respective electrodes, each said electrode plate having a center line electrode which extends diametrically relative to said associated electrode on said varistor, a plurality of line electrodes which extend on both sides from said center line electrode, and an external terminal led form one part of said each electrode plate.

* * * * *